US007174691B2

(12) United States Patent
de Garay Arellano

(10) Patent No.: US 7,174,691 B2
(45) Date of Patent: Feb. 13, 2007

(54) ALUMINUM PROFILE SYSTEM FOR PLACING DOORS, WINDOWS AND PARTITION WALLS

(76) Inventor: David Antonio de Garay Arellano, Francisco Petrarca 223-204, Col. Chapultepec Morales (MX) DF 11000

( * ) Notice: Subject to any disclaimer, the term of this patent is extended or adjusted under 35 U.S.C. 154(b) by 91 days.

(21) Appl. No.: 10/426,033

(22) Filed: Apr. 30, 2003

(65) Prior Publication Data

US 2004/0025456 A1 Feb. 12, 2004

Related U.S. Application Data

(63) Continuation of application No. PCT/MX01/00083, filed on Oct. 31, 2001.

(30) Foreign Application Priority Data

Oct. 31, 2000 (MX) ..... 010717

(51) Int. Cl.
*E04C 2/38* (2006.01)

(52) U.S. Cl. ..... 52/716.1; 52/213; 52/211; 52/730.6; 52/204.54; 52/717.01; 52/656.9

(58) Field of Classification Search ..... 52/204.5, 52/212, 716.1, 213, 211, 730.3, 730.6, 734.1, 52/204.53, 204.54, 717.01, 656.2, 656.9, 52/281, 236.9, 238.1; 403/169, 170, 174, 403/175, 402, 403, 286, 295, 298, 285
See application file for complete search history.

(56) References Cited

U.S. PATENT DOCUMENTS 3,592,289 A * 7/1971 Aysta et al. ..... 160/135
3,685,222 A * 8/1972 Curtess ..... 52/92.2
4,226,066 A 10/1980 Persson
4,266,387 A * 5/1981 Karlsson ..... 52/731.3
4,281,480 A 8/1981 Wendt
4,356,672 A * 11/1982 Beckman et al. ..... 52/36.6
4,438,614 A * 3/1984 Raith et al. ..... 52/580
4,614,068 A 9/1986 Bergthold (Continued)

FOREIGN PATENT DOCUMENTS

ES 1041443 U 7/1999

*Primary Examiner*—Naoko Slack
*Assistant Examiner*—Chi Q. Nguyen
(74) *Attorney, Agent, or Firm*—Stanley H. Kremen

(57) ABSTRACT

This invention is related to the construction industry. More specifically, it is related to a metal profile for the construction of support frames for doors and windows and providing a finished look to such doors and windows with an elegant touch. The advantages of this invention are that it allows for the work of preparing, leveling and installing support frames for doors and windows without affecting the finished look of the planes that include the fenestration, eliminating possible damages to the finish of the planes that include the fenestration. In case of maintenance or repair work, it is easily disassembled in a partial manner and reassembled in the same way, as well as to easily attach to it certain accessories that will make it versatile for its use on the fenestrations of doors, windows, and mid-height division walls. The invention is a system including a longitudinal H-shaped base; a cover, also longitudinal, fixed separably to the base; a series of variously-shaped connectors of flexible plastic; and accessories that allow for doors, windows and glasses to be fixed to the cover.

15 Claims, 13 Drawing Sheets

U.S. PATENT DOCUMENTS 4,625,483 A * 12/1986 Zacky et al. ..... 52/239
4,852,317 A * 8/1989 Schiavello et al. ..... 52/239
5,038,538 A 8/1991 Rozon
5,063,711 A 11/1991 Huelin
5,355,650 A 10/1994 Agar
5,412,909 A 5/1995 Wu
5,555,684 A * 9/1996 Galowitz et al. ..... 52/204.5
5,570,548 A * 11/1996 Hopper ..... 52/204.5
5,622,017 A * 4/1997 Lynn et al. ..... 52/209
5,966,891 A * 10/1999 Fagan et al. ..... 52/656.9
6,052,958 A * 4/2000 Miedema et al. ..... 52/284
6,393,782 B1 * 5/2002 Berridge et al. ..... 52/239
6,405,504 B1 * 6/2002 Richardson ..... 52/461
6,615,556 B2 * 9/2003 Cates et al. ..... 52/210
6,658,778 B2 * 12/2003 Roy ..... 40/782
6,761,004 B2 * 7/2004 Anglin et al. ..... 52/238.1

* cited by examiner

F 4

F 10

F 11

F 12

ALUMINUM PROFILE SYSTEM FOR PLACING DOORS, WINDOWS AND PARTITION WALLS

This application is a continuation of PCT application number PCT/MX01/00083, filed on Oct. 31, 2001, which claims priority from Mexican application number 010717, filed on Oct. 31, 2000, which is hereby incorporated by reference.

I. SCOPE OF THE INVENTION

This invention is related to the construction industry. More specifically, it is related to metal profiles for the construction of support frames for doors and windows and to provide a finished look to such door and window openings with an elegant touch.

II. BACKGROUND OF THE INVENTION

The construction of division walls in all types of buildings is a common activity that is regularly performed according to the specific needs of each tenant. Once the final use of the building is decided the interior walls are built on which we find the fenestrations to install doors and windows.

In general, division walls are made of compressed plaster, wood, paneling or lightweight bricks. Generally, the division walls are made so that they can be finished in different ways, which due to their specific finishing characteristics require a variety of specialists, such as carpenters, painters, plasterers, upholsterers, general contractors, etc.

The architects and contractors have had to absorb the additional costs of the work needed to adjust and cut the fenestrations that are required when installing the structure that will hold the doors and windows on the finished division walls.

Considering that once the doors and windows have been installed, it is common that due to the damage suffered by the division walls during the installation process of the doors and windows, the group of specialists has to be called back to repair the damage, so it is wise to consider alternative building systems.

There have been efforts to solve the above-referenced problem with other systems such as the ones described in U.S. Pat. Nos. 5,038,538 and 5,412,909. The first of these systems, U.S. Pat. No. 5,038,538 to Roson, describes a profile composed of a slot (or opening) into which brackets are regularly spaced; these brackets are adapted to be fixed through friction into the slot, and it includes the means to fix the member of the structure to nearby studs and supports by means of resilient elements adapted to provide angular adjustment to the members. This adjustment advantage has its counterpart in the fact that the means of fixation can give way and lose their adjustment so that the element is left unfastened.

U.S. Pat. No. 5,412,909 to Wu et al. raises and solves the question that arises from applying the product to old structures to cover them and provide a better look.

Both patents have certain inconveniences, such as adjusting the ends of the segments to be fixed.

III. SUMMARY OF THE INVENTION

The main objective of the invention is to perform the preparations, leveling and fixing of the window and door frames without affecting the final finish of the dividing wall.

An embodiment according to the invention is a system of aluminum profiles for the installation of doors, windows and dividing walls, characterized by a longitudinal "H"-shaped base, that is fixed to the door and window fenestrations or the sides of dividing walls; a cover having a longitudinal shape, fixed separably to the base and covering the base as well as the fenestrations and sides; a series of variously-shaped connectors made of flexible plastic that allow for the base and the cover to be joined at the longitudinal ends and for the system to change direction, the crossing of the system or the finish of the ends; and accessories that allow for doors, windows and glass to be fixed to the cover.

An embodiment according to the invention is a system for finishing walls including doorways and window frames, the system including at least one base having a "H' cross-section, at least one cover having a central member, a leg extending out from the central member, the legs running the length of the central member, and a bracket formed along a bottom surface of the central member, the bracket running the length of the central member, the bracket attachable to one of the at least one base, and at least one connector capable of engaging at least one of the at least one base and at least one of the at least one cover, the connector including a central body, the connector includes at least one set of projections extending from the central body, the at least one set of projections having at least two lateral projections, and a central projection having a passageway passing therethrough, and wherein the projections are spaced from each other. The system more specifically having a base that includes a crossbeam having a central channel with a plurality of holes passing therethrough running the length of the central channel, and a pair of legs, each of the legs are on opposite ends of the crossbeam, each of the legs includes a channel running in the longitudinal direction of the leg, the base of the cover includes a crossbeam having a central channel with a plurality of holes passing therethrough running the length of the central channel, and a pair of legs, each of the legs are on opposite ends of the crossbeam, each of the legs includes a channel running in the longitudinal direction of the leg, the bracket of the cover includes a pair of opposing horizontal projections extending in from one of the legs, and a vertical projection extending down from each of the horizontal projections, each of the vertical projection including a groove running in the longitudinal direction of the vertical projection, each of the groove formed to be engageable with a respective one of the grooves in the legs of the base, each of the legs includes at least one step attached to the horizontal central segment, a horizontal lateral member extending from the at least one step, a sloped lateral member extending out from the horizontal lateral member, and a member extending down from the sloped lateral member. The system more specifically having the following types of connectors: at least one cornerpiece having two sets of projections, each set extending from an adjacent sides of the central body to each other, at least one stop having at least one set of projections extending from one side of the central body, at least one section union having two sets of projections, each set extending from opposing sides of the central body to each other, at least one T joint connector having three sets of projections, the sets extending from the central body to form a T shape. A method for installing the system as defined above including determining the lengths of cover and base pieces needed, cutting the cover and the base into appropriate lengths, determining which type of connectors will be needed to connect the cover and base pieces during the installation, attaching the base pieces to the building structure with screws making sure that the base pieces are level, attaching the selected connectors to the respective base pieces, attaching cover pieces to base pieces and connectors by snapping cover pieces over the base pieces and connectors such that the legs of the base pieces pass through spaces between projections of the connectors to snap together with the brackets of the cover pieces.

An embodiment according to the invention is a connector for use in a system having segments of a base piece attached to a cover piece, the system for providing a finished look in building construction for partial walls, walls, door frames, and windows frames, the connector including a central body having a plurality of surfaces including a surface that forms a continuous shape with the cover after installation, and at feast one set of projections extending from another surface of the central body, the projection set including a central projection having a passageway therethrough to facilitate affixing the connector to a base and a wall of the building, and a pair of lateral projections on either side of the central projection and spaced from the central projection, wherein the space between the projections allows for connection of a cover to a base, and the projections formed to fit between the cover and the base after installation.

Another objective of this invention is to provide a system that can be installed in two parts, starting with the part that is secured to the wall, and then correcting any imperfections before applying the final part of the system.

Yet another objective is to make it possible for this system to eliminate damages to the finish on the dividing wall.

Still another objective (characteristic) is that this system can be partially unassembled and reassembled very easily, in the event of maintenance or other work to be performed.

Another objective is to have an aluminum profile whose shape allows easy installation of certain accessories that make it versatile enough to be used as window and door frames, as well as mid-height division walls.

And all the other qualities and objectives that will become apparent and clear in the following description of an exemplary embodiment of this invention as supplemented by the accompanying illustrations.

In broad terms, this invention preferably includes a system of frames made up of two types of aluminum profiles: a base and a cover, and a series of seven different connectors made of plastic or polymer resins, with a certain flexibility, which can be made in virtually all the different shapes of division walls.

The shapes of the different elements that make up the system, as well as their ability to connect among each other, provide considerable versatility to the system. The plastic connectors, made of a flexible material, give an aesthetic finish, and absorb certain tolerances that metals normally do not handle.

The shape of the base profile, which can be described as an "H" with a depression in the center of the horizontal cross-section, in the shape of a rectangular canal, provides the mechanical rigidity and resistance required to support the mechanical forces occurring during normal use, allows for a certain deformation in order for the cover to fit, and provides an area to insert the screws that will fix the base to the area where it will be installed.

For the fitting of the cover, the base has a hook like configuration on the upper part, towards the outside of the vertical members of the "H".

The aluminum cover itself provides the appropriate mechanical resistance and rigidity to avoid permanent deformation, and allows for fitting with the base; it also provides places where one can easily and firmly screw certain accessories to fix a door, a window or a sheet of glass on the cover.

To describe the shape, we will say that the top part has five areas arranged transversally. A central area is completely horizontal, the central segment is horizontal, with the same number of steps descending at a right angle on both sides of the central segment and along the entire length of said central area, forming towards the side the same number of horizontal areas (called horizontal lateral members) that after a certain length descend in a constant slope (forming the sloped lateral members) until it reaches the ends projected downwards vertically for a certain length (forming the legs of the base) so that at the bottom the legs fold at a right angle towards the center of the cover forming a short, horizontal projection.

At the bottom of the cover, directly in the area where the lower ends of the steps come together, the steps come together with the central horizontal area on their upper part, the cover has the same number of horizontal projections projected towards the center of the cover. At certain distance away from this union, through the lower part of said horizontal projections, the cover has the same number of vertical projections projected downwards. The shape of said vertical projections on the inner side of their lower end allows them to attach easily with the corresponding upper extremes of the base of the system.

As for the connectors that connect the different sections of base-covers, the entire group is made up to unite the sections in cross shapes, twisting downwards, changing vertical direction, changing lateral direction, in T unions and terminal, among others.

As for the accessories to set different elements into these frames, such as glass sheets, stops for doors and window sheets, there are, for example, panels, glass-holding jonquils and base glass-holding jonquils.

For a better understanding of the characteristics of this invention, we provide drawings that describe it in an illustrative but not limitative manner.

IV. BRIEF DESCRIPTION OF THE DRAWINGS

The present invention is described with reference to the accompanying drawings. In the drawings, like reference numbers indicate identical or functionally similar elements. The use of cross-hatching and shading within the drawings is not intended as limiting the type of materials that may be used to manufacture the invention.

Figure 1:
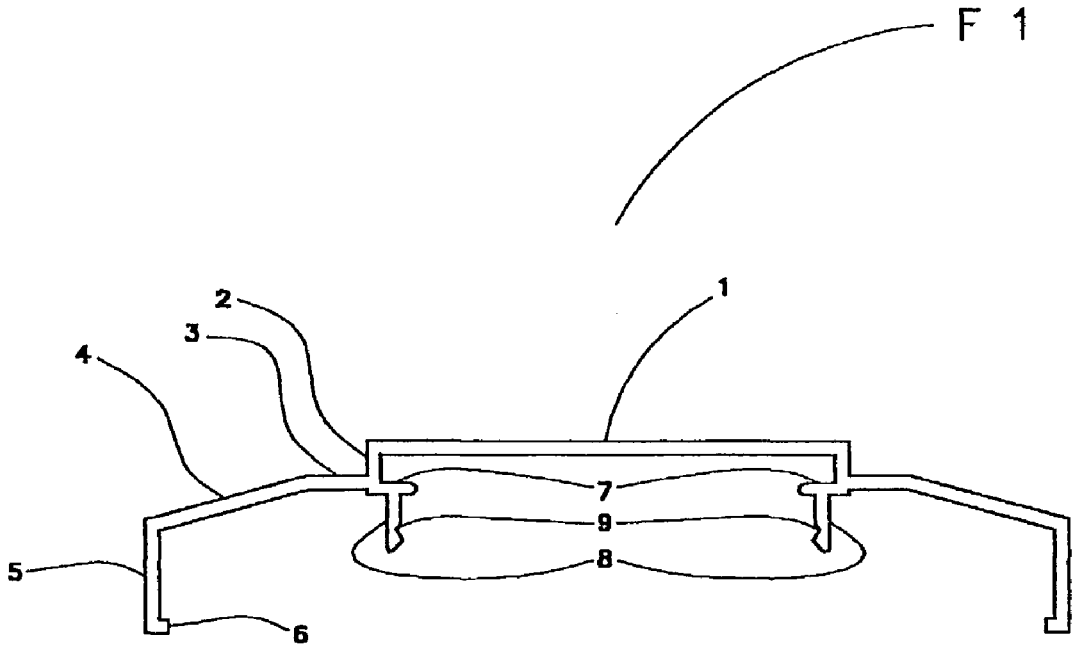
FIG. 1 depicts a transversal cross-section of the cover according to the invention.

To give a better understanding of the invention, we will describe in detail including various exemplary components shown in the drawings attached to this description.

V. DETAILED DESCRIPTION OF THE INVENTION

The details of this innovative system of aluminum profiles for the installation of doors, windows and division walls is discussed in the following description and illustrated as an exemplary embodiment in the accompanying drawings, using the same reference symbols to point out the same parts to which it refers.

FIG. 1 shows a cross-section of the cover F1 of the system having a completely horizontal central area, horizontal central segment 1, with a pair (although additional steps may be present) of steps 2 that descend in a downwards right angle at either side of the central area, along the entire length of the horizontal central segment 1 and forming towards the lateral ends the same number of horizontal areas, called horizontal lateral members 3. The horizontal lateral members 3 after a certain length descend in a constant slope to form the sloped lateral members 4. Depending at the end (spaced from the horizontal lateral member 3) of the sloped lateral member 4 is a leg 5, which preferably is vertical. Each of the legs 5 preferably includes a projection 6 that preferably is a short horizontal piece that forms a right angle with the legs and extends towards the center of the cover F1.

Now, through the lower part of the cover F1, directly in the areas where the bottom ends of steps 2 join the lateral horizontal members 3, the cover F1 includes the same number of horizontal projections 7 projecting towards the center of the cover F1. Spaced from the point where the horizontal projection 7 extends from step 2 and extending from the bottom surface of the horizontal projection 7 is a vertical projection 8 projecting downwards from the horizontal projection 7. The shape of the lower inner end 9 of each vertical projection 8 allows it to attach easily with the corresponding upper end 23 of the base F2.

Figure 2:
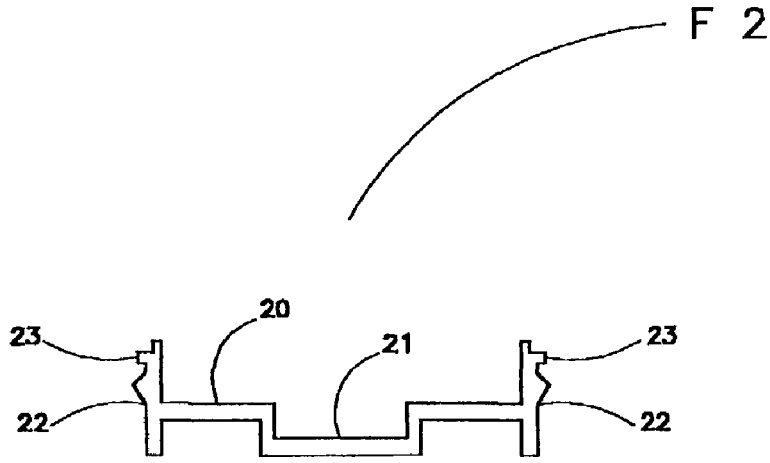
FIG. 2 illustrates a transversal cross-section of the base according to the invention, whose cover is shown in FIG. 1.

The base F2 preferably is shaped like an "H" as shown in FIG. 2. In its crossbeam 20, the base has a central deformity (or canal or trough) 21 in the shape of a rectangular, concave canal seen from above that gives the base F2 mechanical rigidity and resistance. The trough 21 preferably includes a plurality of perforations or holes (not shown) where screws will be driven to fix the base F2 to the window or door wall or fenestration. This central deformity 21 is in the same plane as the bottom of the ends of the legs 22 of the H. In this way, the base F2 is rigid and mechanically resilient, and includes a bracket to set itself against the surface of the construction when installed.

On the upper ends and on the outside surface of each of the vertical members (or legs) 22 there is a hook-shaped projection 23, which matches the shape of the ends 9 of the vertical projections 8 of the cover F1. Both parts make up the places where the cover F1 will be connected together with the rest of the system. The system will attach to the door or window fenestration or the part of the wall where the system will be installed through screws that will be located at the center of the canal 21, throughout the entire length of the base F2. It goes without saying that the screws will be hidden when the cover F1 is placed over the base F2.

Regarding the other elements in the system, the unions or ends of the cover-bases and the accessories to fix other elements to the system, such as panels F10, glass-holding jonquils F11 and base glass-holding jonquils F12 will be described hereafter.

Figure 3:
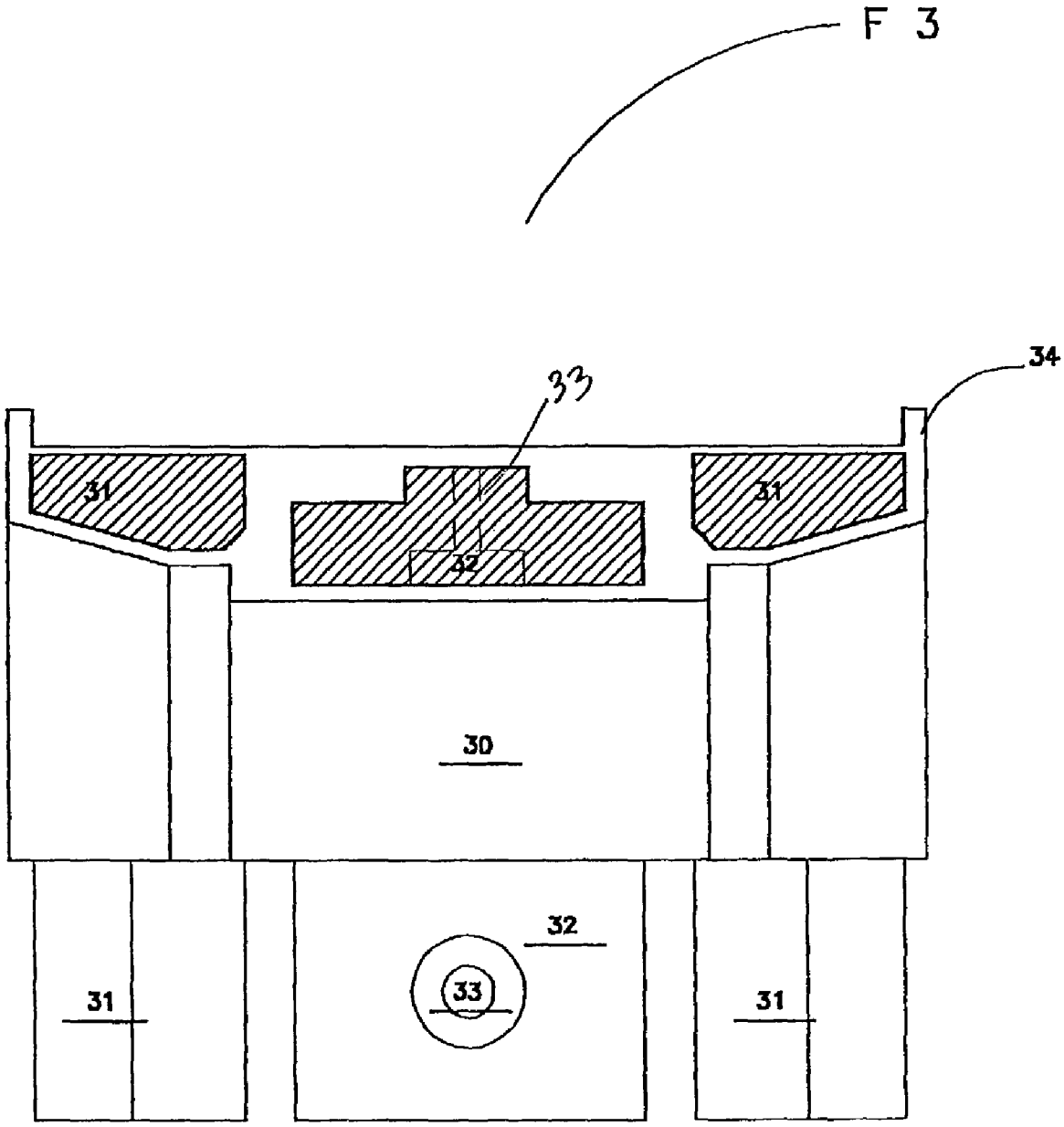
FIG. 3 depicts a top view of the interior cornerpiece according to the invention.

FIG. 3 shows a top view of the interior cornerpiece F3 of the system. The interior cornerpiece F3 includes six projections with three projections extending from two surfaces of a central body 30 of the cornerpiece F3.

The central body 30 is what will be visible once the system is installed, and the projections 31 and 32 will be hidden by the cover F1. These three projections 31 and 32 are made up of two lateral projections 31 and one central projection 32. The space present between adjacent projections 31 and 32 allows for one of the legs 22 of the base F2 to pass through and connect with the vertical projection 8 of the cover F1, which also may be present within the same space.

In the central projection 32 of the interior cornerpiece F3 there preferably is a passageway (or space or hole) 33 through which a screw or other similar means of connection such as a bolt or a nail will be inserted to fix the cornerpiece F3 to the door or window wall or fenestration. The space 33 is shown in phantom in the horizontal central projection 32 shown in FIG. 3. The shape of these projections 31 and 32, on their upper or outer part, more or less coincides with the shape of the cover F1. In any case, there is a difference between the upper level of the visible part, that is, the main body 30, and the upper level of the projections 31 and 32, which is compensated for by the cover F1.

Also, the shape of the underside of the central projection 32 is such that it can be attached to the upper side of the base F2, fixing the cornerpiece F3 firmly on the surface on which it will be installed. The shape of the lateral projections 31 are not important and may or may not coincide in shape with the sloped lateral members 4 of the cover F1. The projections 31 and 32 are able to fit within the cavities created by the cover F1 and the base F2.

The symmetry of the cornerpiece F3 is such that what is vertical preferably has the same shape and measurements as what is horizontal, at any given moment. As can be appreciated with the cornerpiece F3, once the system is installed, the covers F1 are visible from the same side.

Finally, the cornerpiece F3 preferably includes a pair projections 34 running along its surface from one projection set (31 and 32) to the other projection set (31 and 32) as illustrated in FIG. 3. The pair of projections 34 is visible after installation of the cornerpiece F3, and depending on the width of the door and window fenestrations or the thickness of the wall, will hold them, or the projections 34 will remain on its surface.

Figure 4:
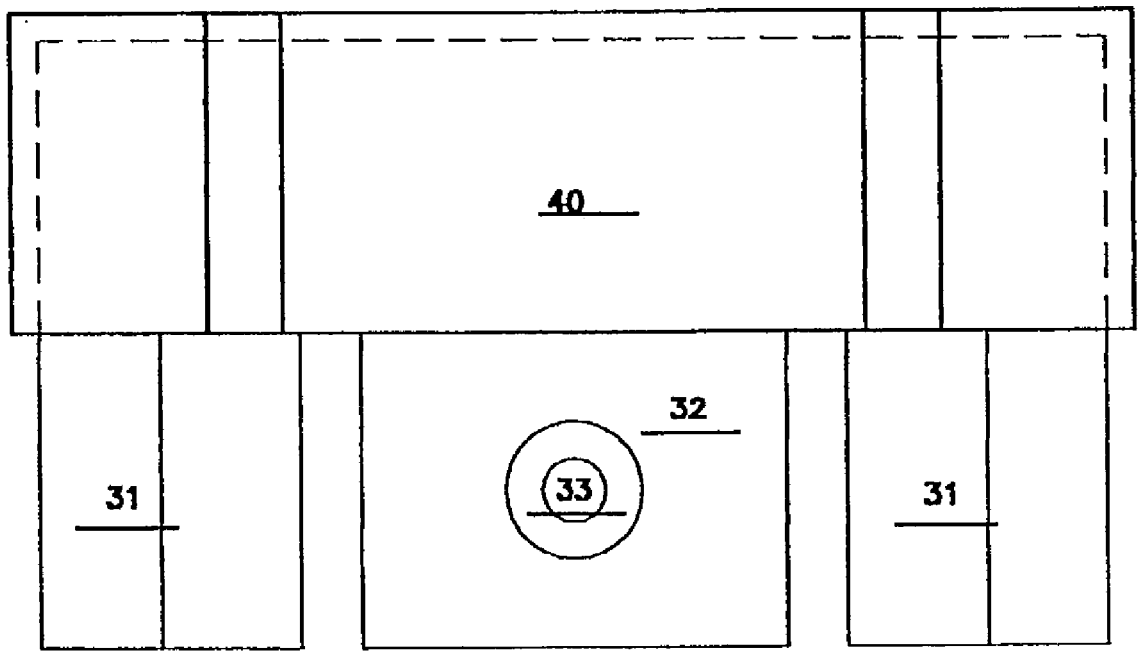
FIG. 4 illustrates a top view of the plastic stop according to the invention.

FIG. 4 shows a top view of the plastic stop F4 of the system. As can be seen, projections 31 and 32 are the same as those described for the cornerpiece F3. The central body 40 of this connector is a modified version of the central body 30 of the cornerpiece F3, because it simply takes the shape of a parallelepiped rectangle, with one set of three projections 31, 32, 31 shown in connection with the cornerpiece F3. In all other aspects, its characteristics are the same as those described for the cornerpiece F3.

Figure 5:
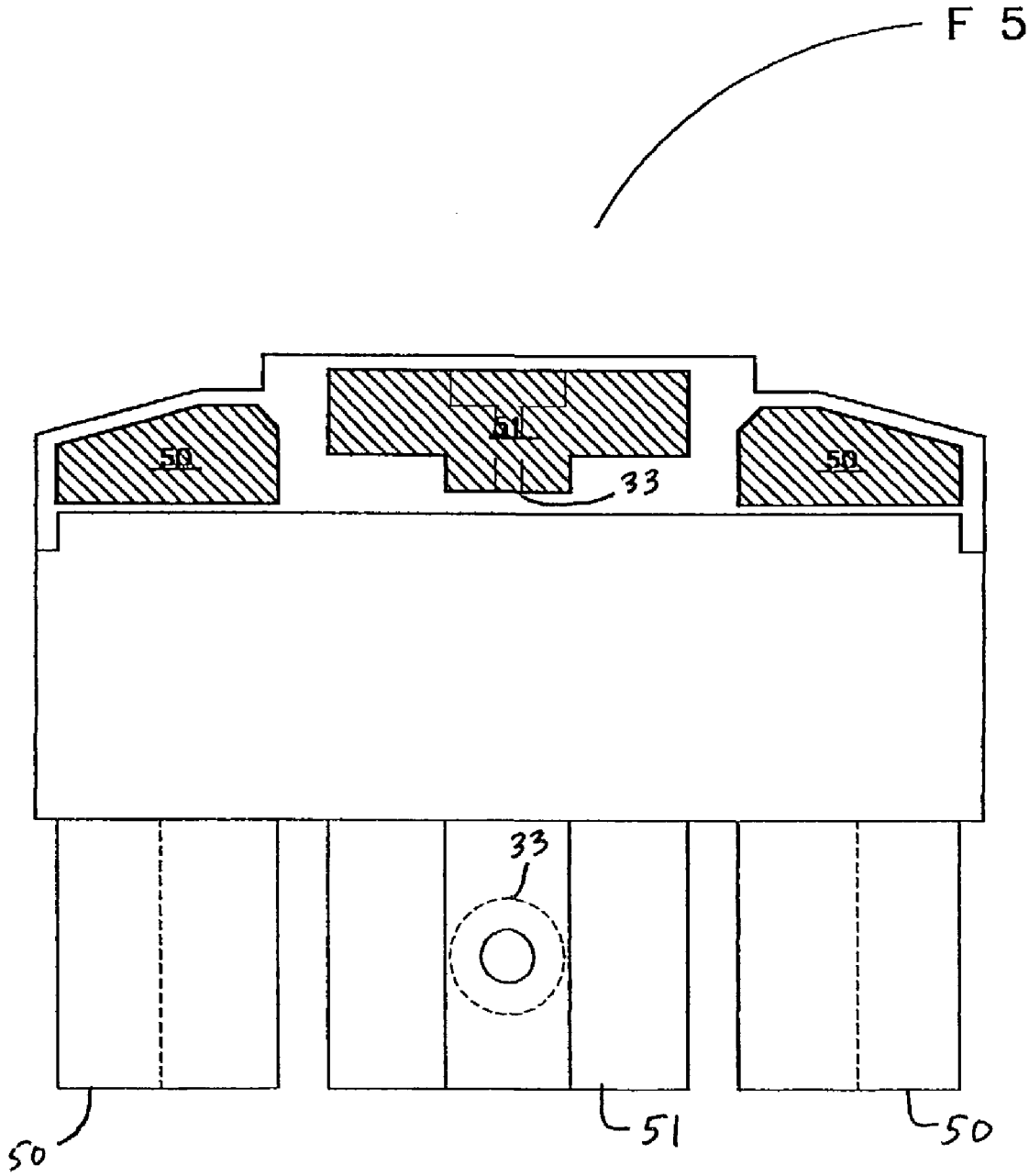
FIG. 5 depicts a top view of the exterior cornerpiece according to the invention.

FIG. 5 shows a top view of the outer cornerpiece F5. The cornerpiece F5 is the same as the cornerpiece F3 shown in FIG. 3, except for the position in which it will receive the cover F1. With the cornerpiece F5, the covers go different ways when attached to it, that is, the covers face into the 90 degree angle that is formed by them (i.e., the finished cover surface would face up for the horizontal cover and into the page of FIG. 5 for the vertical cover), which is the opposite relationship that occurs when the covers are attached to the inner cornerpiece F3. This is because projections 50 (lateral projection) and 51 (central projection) are rotated 180° in comparison to the same projections 31 and 32 of the inner cornerpiece F3 shown in FIG. 3. Projection 51 also has a passageway 33 passing through its height.

Figure 6:
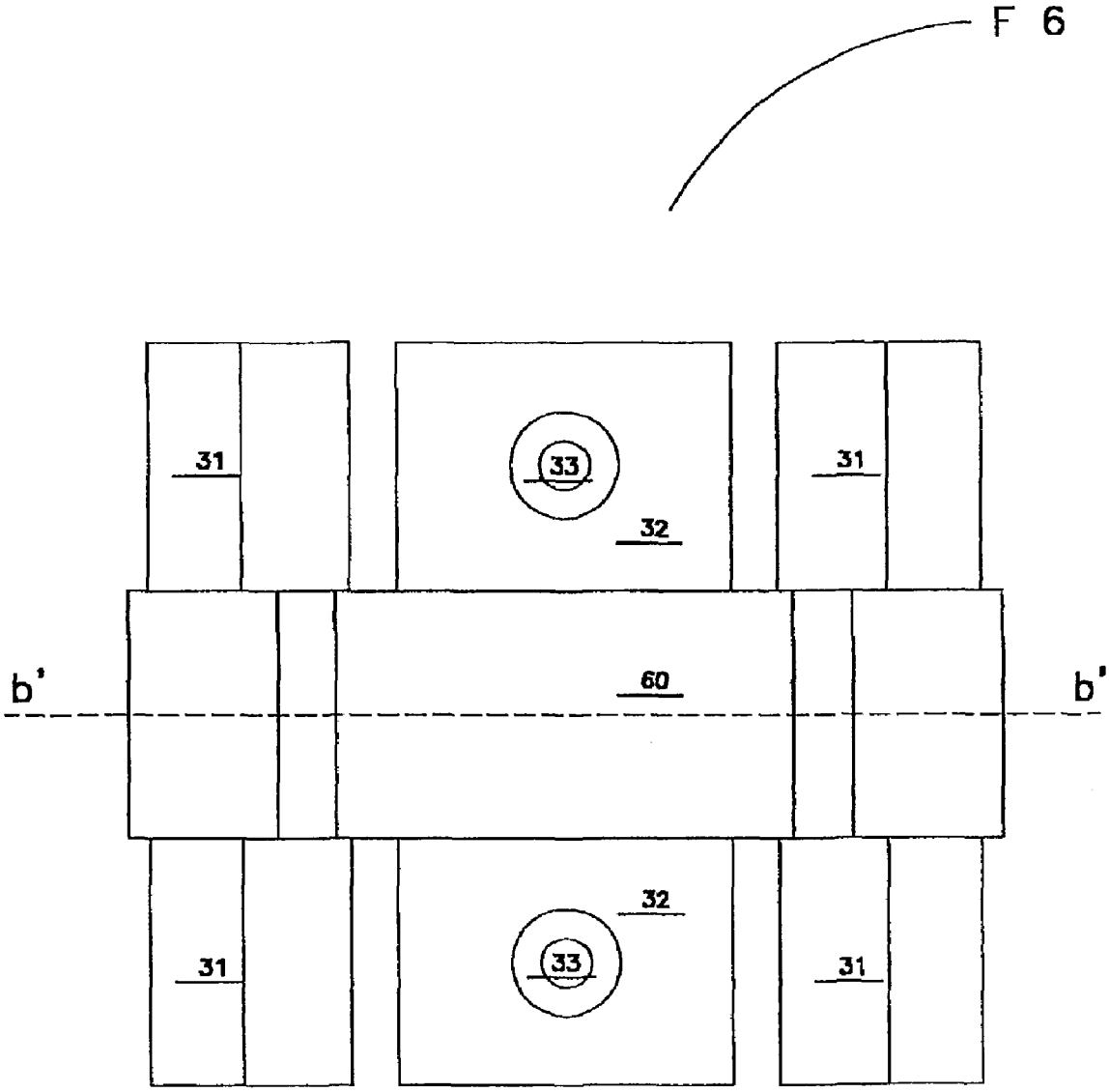
FIG. 6 illustrates a top view of the union of sections at the base and cover according to the invention.

FIG. 6 shows another one of the systems joints (or connectors). The section union (or section connector) F6 connects adjacent couplings (or segments) of a base F2 and a cover F1. This coupling F6 has a symmetry axis in line b'—b' and projections 31 and 32, together with orifice 33, are the same as those in previous Figures. The central body (or union) 60 of this coupling F6 is very similar to the main body 40 of the stop F4 in FIG. 4. The section union F6 is useful for times when a base-cover segment is to short to cover an area and additional base-cover segment needs to be attached to provide sufficient length. The section union F6 is capable of continuing the same contour as the cover F1, but does not have to depending upon the desired look.

Figure 7:
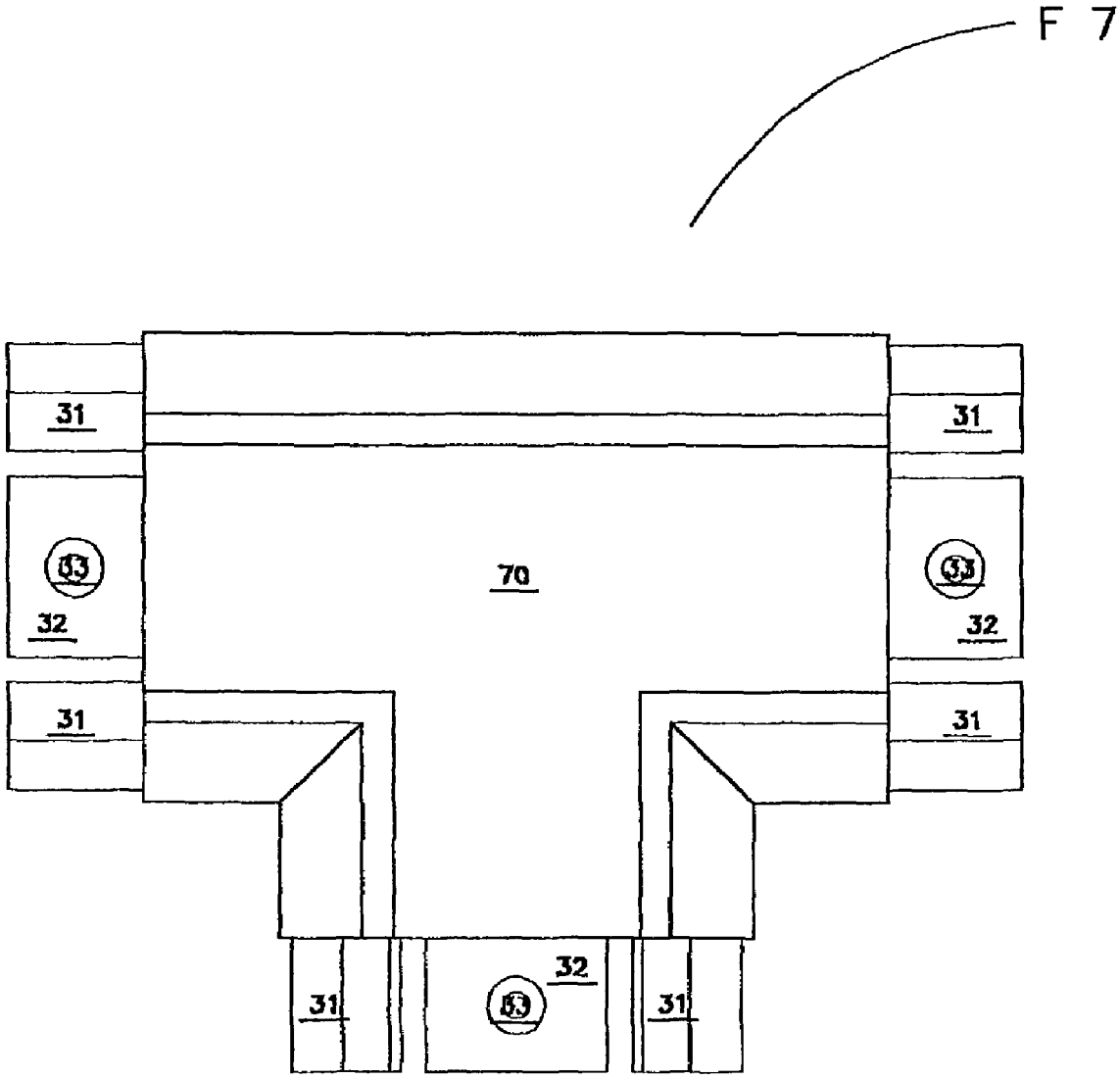
FIG. 7 depicts a top view of the T-connector according to the invention.

FIG. 7 shows a top view of the T joint part (or connector) F7 of the system. The main body (or central body) 70 of this coupling F7 takes on the shape of a "T" having projections 31 and 32 as well as orifice 33 passing through projection 32 on each of the extremes of the "T". The shape of the upper part of the "T" is such that it and the attached covers are all in the same plane and the upper shape of the ends of the attached covers will coincide with the ends of the "T".

Figure 8:
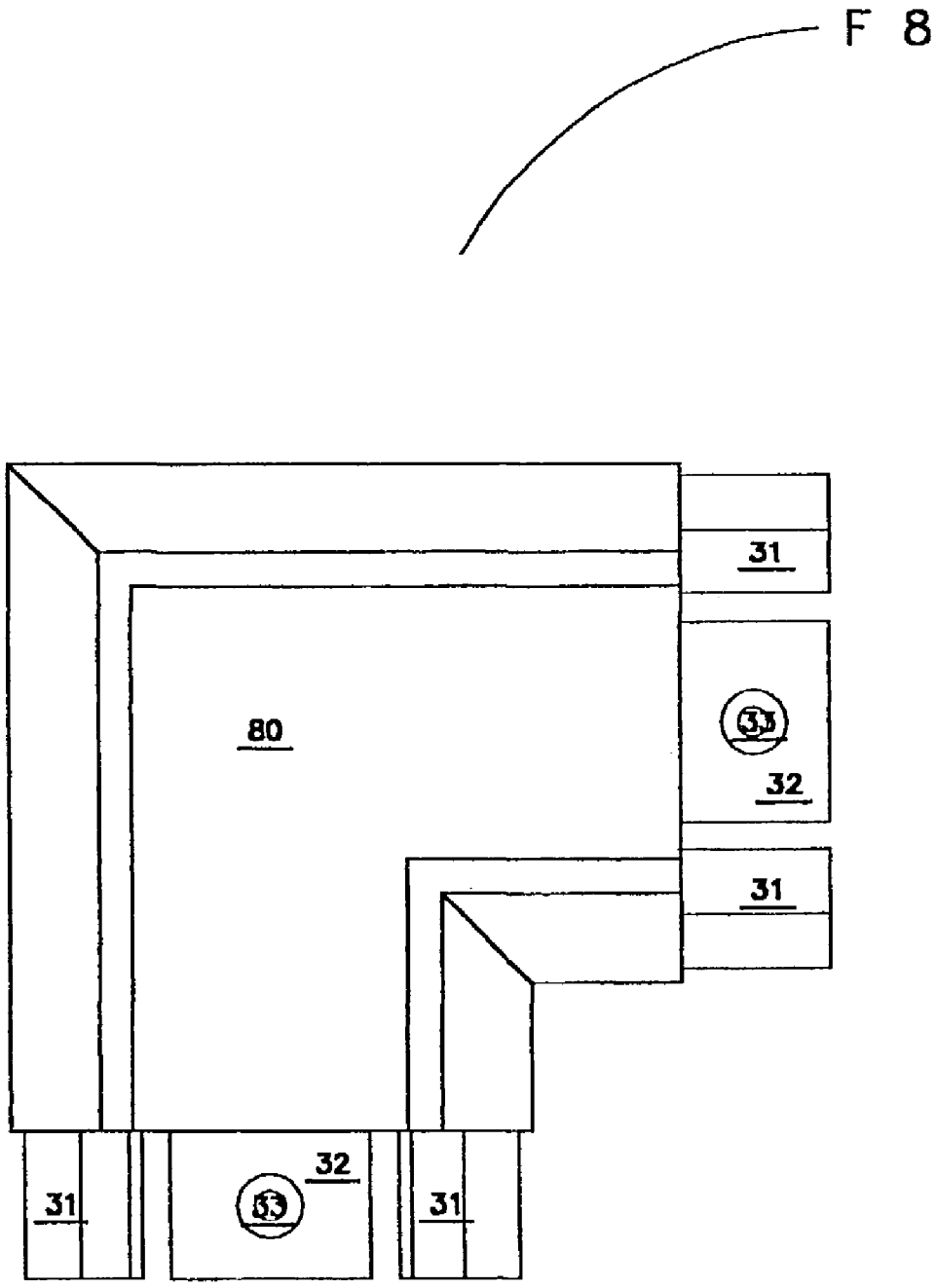
FIG. 8 illustrates a top view of the L connector according to the invention.

FIG. 8 shows a top view of the L connector F8. It is the main body (or central body) 80 of this coupling F8, which takes on the shape of an L, and has at its ends projections 31 and 32, as well as orifice 33 passing through projection 32. This coupling F8 is also used to turn it left and right without having to make any changes to it.

Figure 9:
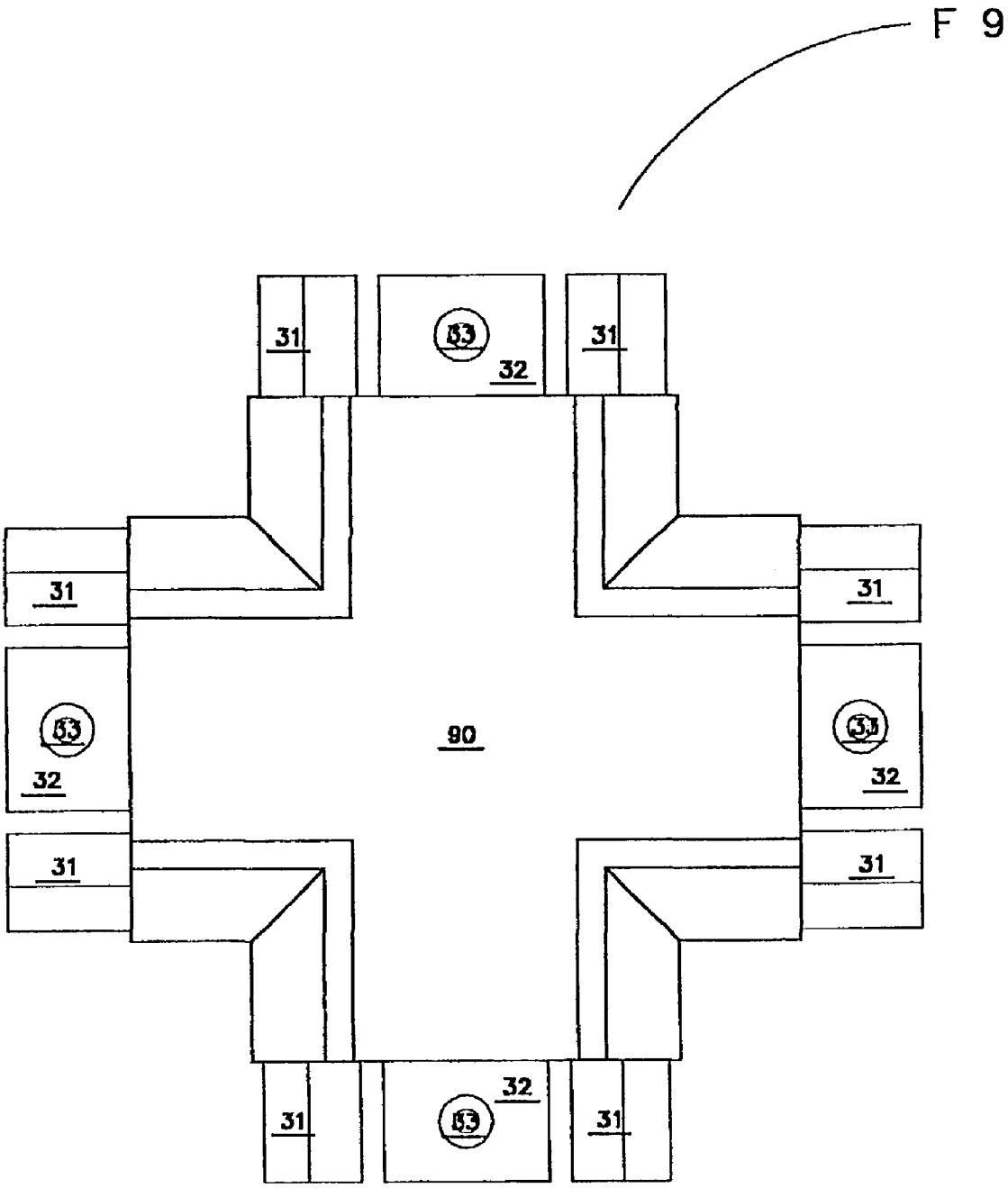
FIG. 9 depicts a top view of the cross connector according to the invention.

FIG. 9 shows a top view of the cross connector F9. The cross connector F9 is used for molding intersections of four covers on top of, for example, half division walls that cross paths. The main body (or central body) 90 takes on a cross shape with four ends each having projections 31 and 32. Passageway 33 passes through projection 32 at a point spaced from the main body 90.

Figure 10:
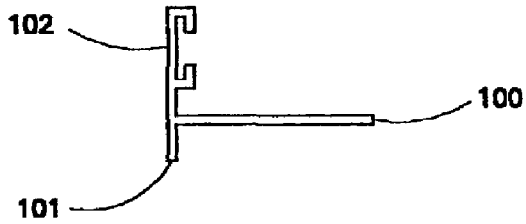
FIG. 10 illustrates a cross-sectional view of a panel according to the invention.

FIG. 10 shows a cross-section of a panel (or door sash) F10. This accessory preferably is attached to the cover F1 with screws spaced along a horizontal segment (or member) 100 as illustrated, for example, in FIGS. 15 and 16. Alternatives to using screws are, for example, nails, rivets and/or glue (or other adhesive). A vertical segment (or member) 101 is shaped to abut one of the steps 2 of the cover F1. The space (or channel) 102 formed on the vertical segment 101 preferably houses a strip of fibrous material (or other cushioning material) (not shown) that cushions the impact of the door with this accessory when the door is in the closed position.

Figure 11:
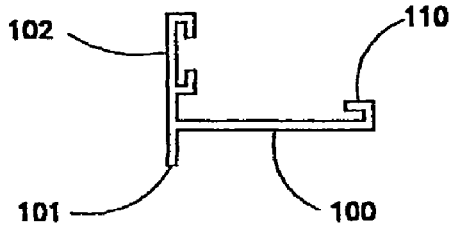
FIG. 11 depicts a cross-sectional view of a glass-holding jonquil according to the invention.

FIG. 11 shows a cross-section of the glass-holding jonquil (or glass-holding structure or window sash) F11. As can be seen, besides segments 100, 101 and 102 of the panel F10, the window sash F11 includes a fold 110 extending along one edge of the segment 100. The fold 110 preferably keeps the glass sheet in place within the window sash F11 between the fold 110 and channel 102.

Figure 12:
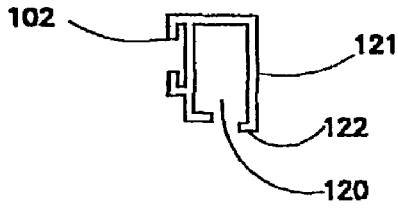
FIG. 12 illustrates a cross-sectional view of a base jonquil according to the invention.

FIG. 12 shows a transversal cross-section of the base glass-holding jonquil (or base window sash) F12. This accessory, apart from lodging 102, includes another space (or channel) 120 formed on one side by the continuous arm 121 (vertical component or member) and 122 (horizontal component or member). The base window sash F12 preferably is for installation along the bottom of the window with the glass fitting into the channel 120.

Figure 13:
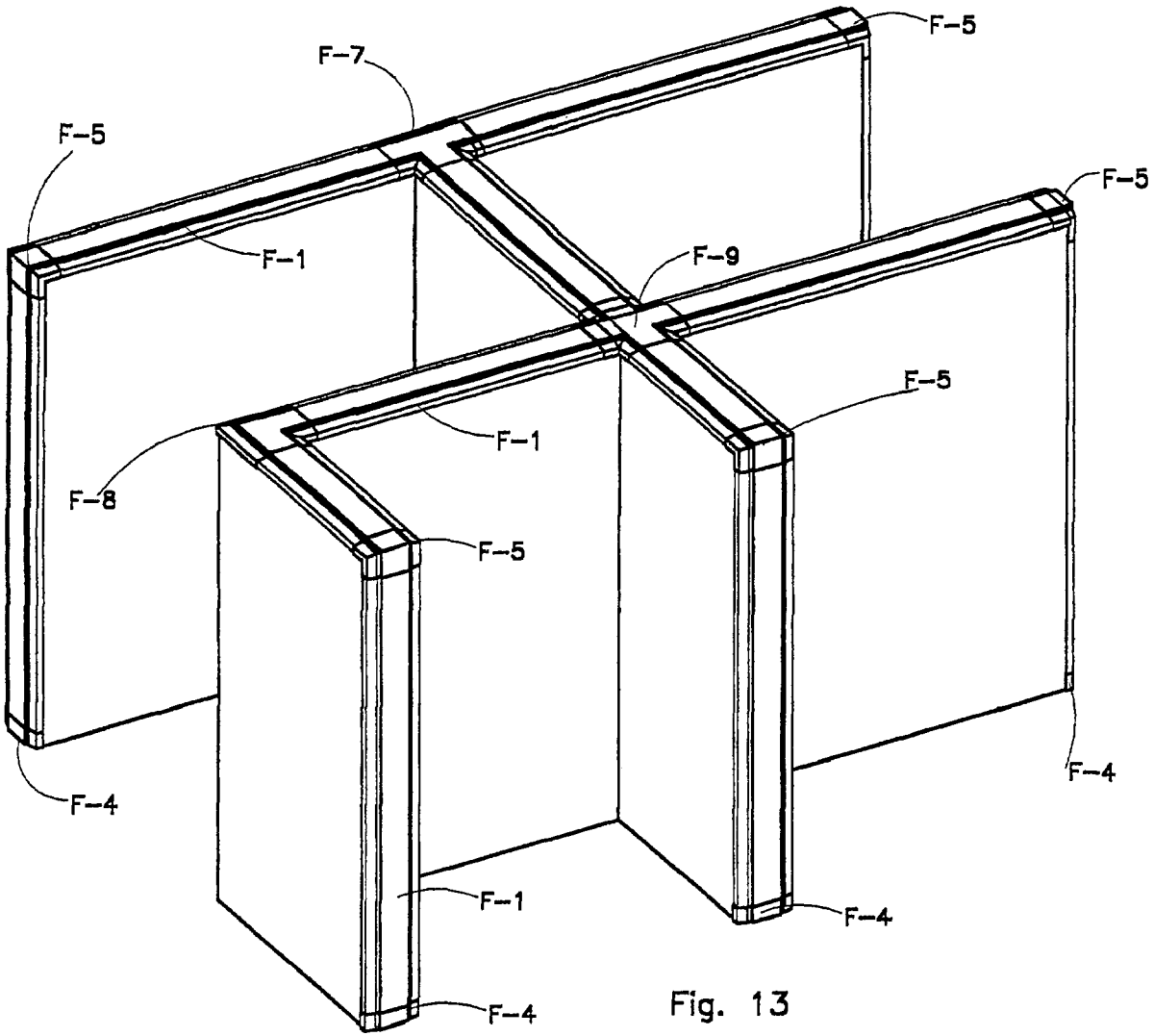
FIG. 13 depicts a conventional view of an exemplary installation on half walls according to the invention.

FIG. 13 shows what the system looks like once it is installed in an exemplary embodiment. FIG. 13 shows a conventional perspective of the system installed on half walls. FIG. 13 illustrates an exemplary embodiment showing the final finish of some half walls when their sides are covered by this system. This illustration shows covers F1, both vertically and horizontally, and in the spots where the adjacent covers F1 are connected through the outer cornerpiece F5, the stop F4, the T joint part F7, the L connector F8, and/or the cross connector F9.

Figure 14:
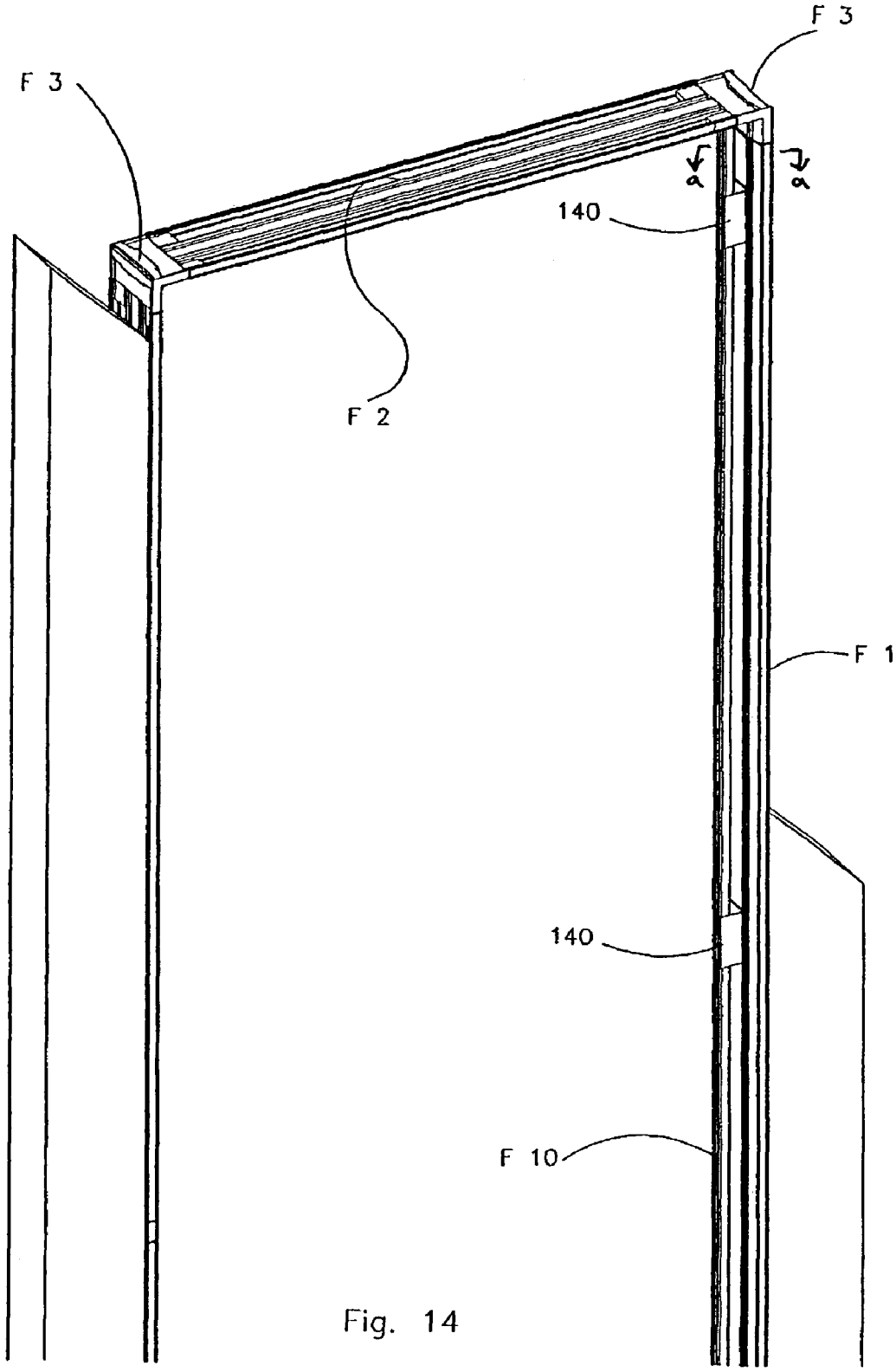
FIG. 14 illustrates a conventional view of an exemplary installation in a door fenestration according to the invention.

FIG. 14 shows a conventional perspective of the system installed in the fenestration of a door. The covers F1 can be seen on the right side of the installed system, while the base F2 can be seen as the crossbeam, because this is a top view of this piece without the presence of a header. In this perspective view, the inner cornerpiece connectors F3 in the upper corners and the connector stops F4 at the base of the legs are illustrated. FIG. 14 also shows a hinge 140 and the panel F10 attached to the cover F1 on the right side of the doorway.

Figure 15:
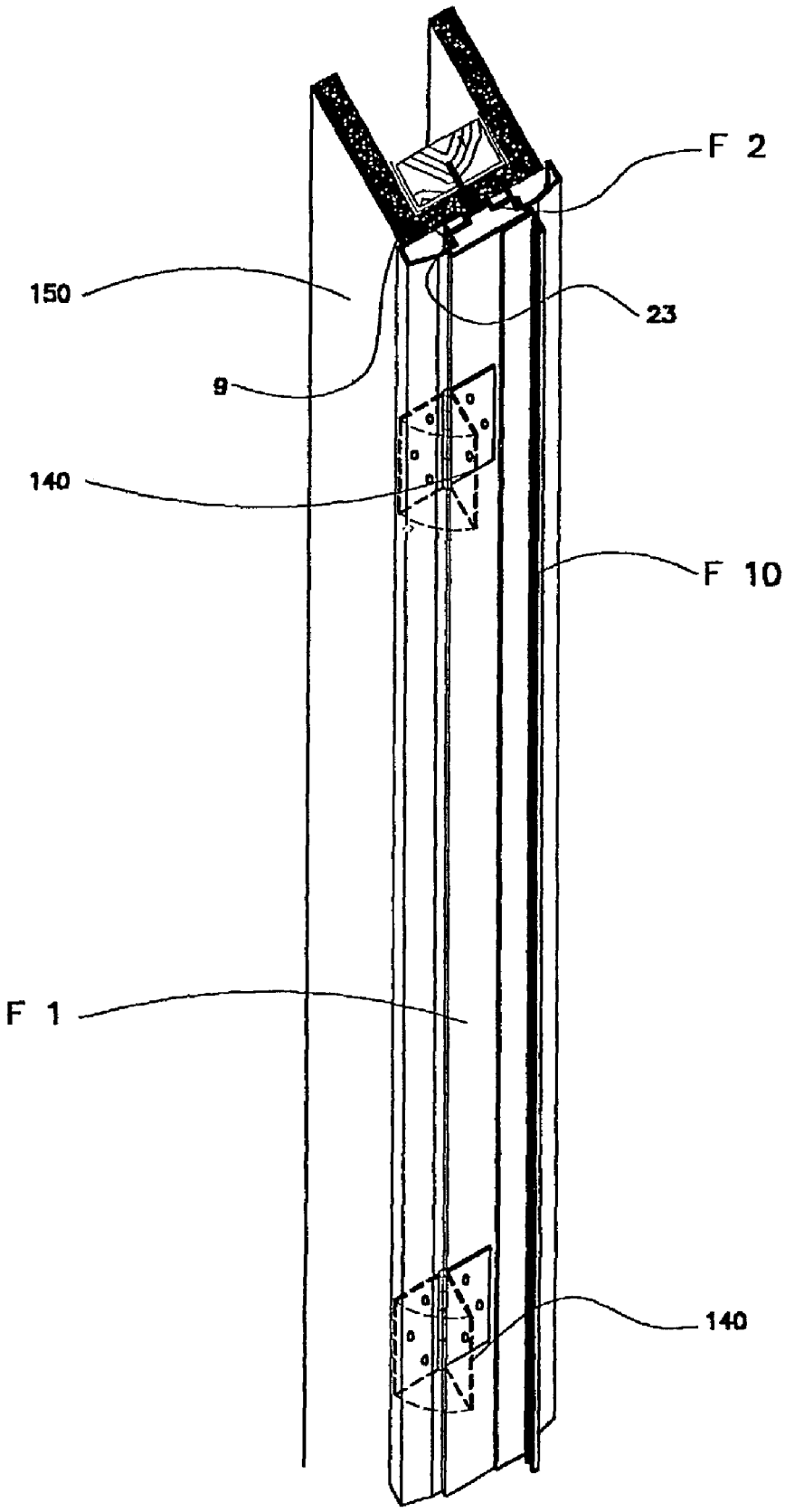
FIG. 15 depicts a perspective view with a partial cross-sectional view of an exemplary installation of the connection between the cover and the base according to the invention.

FIG. 15 shows a conventional perspective with a cross-section of the connection between the cover F1 and the base F2, once the system has been installed onto the wall 150. FIG. 15 also shows the hinge 140, the panel F10 and the wall 150. The cover F1 and the base F2 are illustrated as being joined together by the projections 9 and 23.

Figure 16:
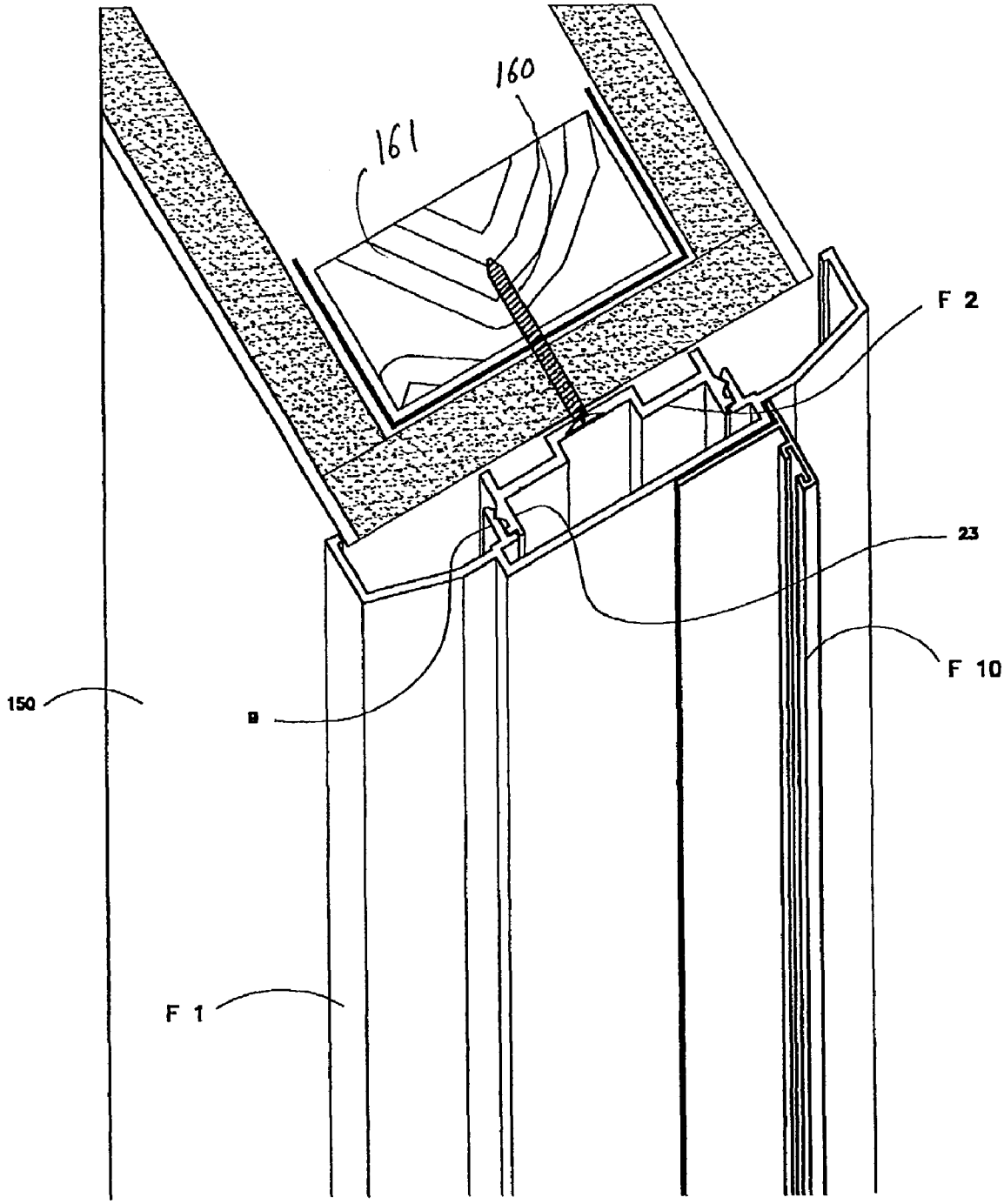
FIG. 16 illustrates an enlarged view with a partial cross-sectional view of the cover joint of the top portion of FIG. 15, that is, in the area where the end of the connector lodges into the base on its upper part, and where the cover covers the upper part of the connector.

FIG. 16 shows a cross-section of the union of the cover F1 and the base F2 and their attachment to wall 150 and the union in the area marked on the cut line a-a, in FIG. 14, that is, in the area where the end of the connector is lodged on to the base F2, fixed by the screw 160, the connector and the base, to wall 161. Part of the legs 5 and the short projections horizontals 6 wrap around the side faces 150 of wall 161.

The above description serves as a basis for the following explanation about the installation procedure, which is very simple, because once the fenestration has been made, be it to place a door frame, a window frame or the sides of a short wall, the installer should check the vertical and horizontal levels, making the corrections required by the presentation of the connectors F3, F5, F7, F8, F9 as the design dictates and the base F2.

Then, the base F2 of the system must be installed, which will be fixed to the different planes, taking care that the surface of the connector adjusts to the base section F2 to insure that the connectors are perfectly aligned and matched.

Once the base F2 has been installed, precise measurements must be made between the edges of the connectors to cut the cover F1 at a right angle. Then, it is recommended that the installer check the correct coupling between the cover F1 and the base F2 and the corresponding connectors.

Assuming that perfect coupling has been achieved, the cover F1 and the corresponding connectors must be removed so the finishes can be applied to these pieces.

After applying the finishes, and when the builder deems it appropriate, the cover F1 will be placed, using the pressure of a blow or other force, and then the accessories for the installation of doors F10 and windows F11, F12 will be installed onto the cover F1.

When installing a door, the panel F10 must be aligned with the edge of the cover step 2 and attached to the connectors by means of conventional screws or other attachment means. The hinges 140 must be aligned with the step 2 opposite to the step 2 where the panel F10 is installed and a convenient distance apart. The screws to fix the hinges are conventional, but care should be taken that the lag screws attach to the base F2 as well as the cover F1.

In case the section of the planes that define the fenestrations are larger than the cover section, a templet made of laminated wood (at least 6 mm high by 9.6 mm wide) should be placed along the entire length of the base F2 and covering the surface that cover the connectors that are needed.

This invention has been sufficiently described so that a person with moderate knowledge of the matter can reproduce it with the results we have mentioned-herein. However, anybody with the technical skills necessary for this purpose can make modifications not described in this document; but if to apply these modifications in a specific structure or in its manufacturing process the reclaimed material in the following claims is required, then said structures should be included within the scope of the invention.

The invention claimed is:

1. A system of metal profiles and flexible plastic end connectors for assembling doors, windows, or panels to edge faces of walls or to edge faces of fenestrations in walls, and for terminating edges of walls comprising:

a) a longitudinal base having an H-shaped profile mounted to an edge face of a wall or of a door opening, or of a window opening in a wall, the profile of said base comprising two legs and a cross-member, wherein each has a first and second end and wherein the base further comprises mounting holes through the cross member;

b) at least one longitudinal cover comprising a central segment, which further comprises a top surface and a bottom surface, and a pair of projections formed to snap onto the first and second ends of the legs of the base to form an assembly of the base and the cover, and a pair of extensions formed to overlap and thereby hide from view the edge face to which the base is mounted; and, c) at least one flexible plastic connector comprising projections formed to engage the assembly of the base and cover.

2. The system of claim 1, wherein the cross-member of the H-shaped profile of the base comprises an offset forming a longitudinal channel.

3. The system of claim 2, wherein the offset is aligned with the second ends of the two legs.

4. The system of claim 1, wherein the projections of the flexible plastic connector are organized to connect two base and cover assemblies at right angles.

5. The system of claim 1, wherein the projections of the flexible lastic connector are organized to connect two base and cover assemblies to form a straight angle.

6. The system of claim 1, wherein the projections of the flexible plastic connector are organized to connect three base and cover assemblies to form two right angles.

7. The system of claim 1, wherein the projections of the flexible plastic connector are organized to connect three base and cover assemblies to form four right angles.

8. The system of claim 1, wherein the projections of each connector comprise:

at least two lateral projections, and a central projection having a passageway passing therethrough, and wherein said projections are spaced apart from each other.

9. The system according to claim 8, wherein said connector is selected from a group consisting of an interior cornerpiece, an outer cornerpiece, a stop, a section union, a T-connector, a L-connector, and a cross connector.

10. The system of claim 1, further comprising at least one window sash.

11. The system of claim 1, wherein each extension comprises:

at least one step attached to said horizontal central segment, a horizontal lateral member extending from said step, a sloped lateral member extending out from said horizontal lateral member, and a vertical member extending down from said sloped lateral member.

12. The system of claim 11, wherein each extension further comprises a projection extending from vertical member.

13. The system of claim 1, wherein the cross-member of said base includes a central channel with a plurality of holes passing therethrough spaced along the length of the central channel, and wherein each leg comprises a channel running in the longitudinal direction of said leg.

14. The system of claim 1, wherein said cover further comprises:

a bracket formed along the bottom surface of the central segment, said bracket running the length of the central segment, said bracket being attachable to at least one base, wherein said bracket further comprises:

a pair of opposing horizontal projections extending in from one of said legs, and a vertical projection extending down from each of said horizontal projections, each of said vertical projection including a groove running in the longitudinal direction of said vertical projection, each of said groove formed to be engageable with a respective one of said grooves in said legs of said base, each of said legs includes at least one step attached to said horizontal central segment, a horizontal lateral member extending from said at least one step, a sloped lateral member extending out from said horizontal lateral member, and a member extending down from said sloped lateral member.

15. The system according to claim 1, wherein each connector is taken from the group consisting of:

a cornerpiece having two sets of projections, each set extending from an adjacent sides of said central body to each other, a stop having at least one set of projections extending from one side of said central body, a section union having two sets of projections, each set extending from opposing sides of said central body to each other, and a T joint connector having three sets of projections, said sets extending from said central body to form a T shape.

* * * * *